US010401767B2

(12) United States Patent
He

(10) Patent No.: US 10,401,767 B2
(45) Date of Patent: Sep. 3, 2019

(54) IMAGE FORMING APPARATUS

(71) Applicant: BROTHER KOGYO KABUSHIKI KAISHA, Nagoya-shi, Aichi-ken (JP)

(72) Inventor: Huimin He, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/142,092

(22) Filed: Sep. 26, 2018

(65) Prior Publication Data

US 2019/0101853 A1 Apr. 4, 2019

(30) Foreign Application Priority Data

Sep. 29, 2017 (JP) ..... 2017-189440

(51) Int. Cl.
*G03G 15/20* (2006.01)

(52) U.S. Cl.
CPC ..... *G03G 15/2039* (2013.01); *G03G 15/2053* (2013.01)

(58) Field of Classification Search
CPC ..... G03G 15/2039; G03G 15/2053
See application file for complete search history.

(56) References Cited

U.S. PATENT DOCUMENTS

2004/0129694 A1* 7/2004 Ishii ..... G03G 15/2003 219/492
2004/0146311 A1 7/2004 Kawazu et al.
2005/0265743 A1* 12/2005 Kubo ..... G03G 15/55 399/69
2006/0093388 A1* 5/2006 Kawazu ..... G03G 15/5004 399/69
2007/0193998 A1 8/2007 Ichino
2011/0305469 A1* 12/2011 Fujiwara ..... G03G 15/2039 399/33
2017/0248894 A1* 8/2017 Yada ..... G03G 15/2039

FOREIGN PATENT DOCUMENTS

| | | | |
|---|---|---|---|
| JP | 2004-226557 | A | 8/2004 |
| JP | 2005-24779 | A | 1/2005 |
| JP | 2007-212536 | A | 8/2007 |
| JP | 2008-164644 | A | 7/2008 |
| JP | 2009-181059 | A | 8/2009 |

* cited by examiner

*Primary Examiner* — G. M. A Hyder
(74) *Attorney, Agent, or Firm* — Merchant & Gould P.C.

(57) ABSTRACT

A heating system includes a heater, a switching circuit providing alternating current to the heater, and a current sensor. The heating system also includes a controller that controls operation of the switching circuit. At a predetermined time during a half cycle, the controller outputs an activation signal to the switching circuit. Based on an elapsed time from outputting the activation signal that a current signal is at least at a predetermined level, the controller calculates a second time from which a current level does not exceed a threshold level during the half cycle, and outputs an activation signal to the switching circuit at the second time. The heating system is useable within an image forming apparatus.

21 Claims, 5 Drawing Sheets

PHASE CONTROL

WAVE-NUMBER CONTROL

IMAGE FORMING APPARATUS

CROSS-REFERENCE TO RELATED APPLICATION

This application claims priority from Japanese Patent Application No. 2017-189440 filed on Sep. 29, 2017, the content of which is incorporated herein by reference in its entirety.

FIELD OF DISCLOSURE

The disclosure relates to an image forming apparatus including a heater and a current sensor configured to detect current flowing in the heater.

BACKGROUND

A known image forming apparatus includes a current sensor and a fuser including a heater. The image forming apparatus executes phase control, based on a value of current detected by the current sensor, to prevent the current to be supplied to the heater from exceeding a maximum allowable current that is allowed to be supplied to the heater.

SUMMARY

One or more aspects of the disclosure provide an image forming apparatus that includes a current sensor and is configured to execute phase control using the current sensor, in which the image forming apparatus may determine low current precisely using the current sensor.

In a first aspect, a heating system includes a heater, and a switching circuit connected to the heater. The switching circuit is configured to be turned on by a turn-on signal, the switching circuit (50) being turned on when alternating current is supplied to the heater. The heating system further includes a current sensor connected between the heater and the switching circuit, the current sensor being configured to output a signal corresponding to a value of current flowing in the current sensor. The heating system further includes a controller configured to: output to the switching circuit, the turn-on signal at a time corresponding to a first phase angle (xn) in a particular half cycle (Hn) of the alternating current; determine a period of time (tn) from the time of the turn-on signal in which a value of current represented by a signal output by the current sensor continues to be greater than or equal to a first threshold (y0) during the particular half cycle; calculate a second phase angle (x(n+1)) based on the determined period of time (tn); and output to the switching circuit, the turn-on signal at a time corresponding to the calculated second phase angle (x(n+1)) in a half cycle (H(n+1)) following the particular half cycle (Hn).

In a second aspect, an image forming apparatus includes a heater and a switching circuit electrically connected between an alternating current power supply and the heater. The image forming apparatus also includes a current sensor electrically connected between the switching circuit and the heater, the current sensor configured to output a current signal representing a sensed current. The image forming apparatus includes a controller communicatively connected to the switching circuit and the current sensor. The controller is configured to: at a predetermined time during a half cycle of an alternating current signal provided by the alternating current power supply, output an activation signal to the switching circuit to provide alternating current to the heater; receive the current signal from the current sensor indicative of the alternating current supplied to the heater; based on an elapsed time from the outputting of the activation signal that the current signal is at least at a predetermined signal level during the half cycle, calculate a second time from which the alternating current signal does not exceed a current threshold for a remainder of the half cycle; and during a second half cycle of the alternating current signal following the half cycle, output a second activation signal to the switching circuit at the calculated second time.

In a third aspect, an image forming apparatus includes a heater and a switching circuit electrically connected between an alternating current power supply and the heater. The image forming apparatus further includes a current sensor electrically connected between the switching circuit and the heater, the current sensor configured to output a current signal corresponding to a sensed current and having a maximum current value output when the sensed current is greater than or equal to a first current value. The image forming apparatus also includes a controller communicatively connected to the switching circuit and the current sensor. The controller is configured to: at a predetermined time during a half cycle of an alternating current signal provided by the alternating current power supply, output an activation signal to the switching circuit to provide alternating current to the heater; receive the current signal from the current sensor indicative of the alternating current supplied to the heater; and based on a determination that the current signal is at the maximum current value during the half cycle for at least some time period, in a second half of a subsequent half cycle, output a second activation signal to the switching circuit at a second time offset from completion of the subsequent half cycle a greater amount than the predetermined time is offset from completion of the half cycle.

DETAILED DESCRIPTION

An illustrative embodiment according to one or more aspects of the disclosure will be described with reference to the accompanying drawings.

Figure 1:
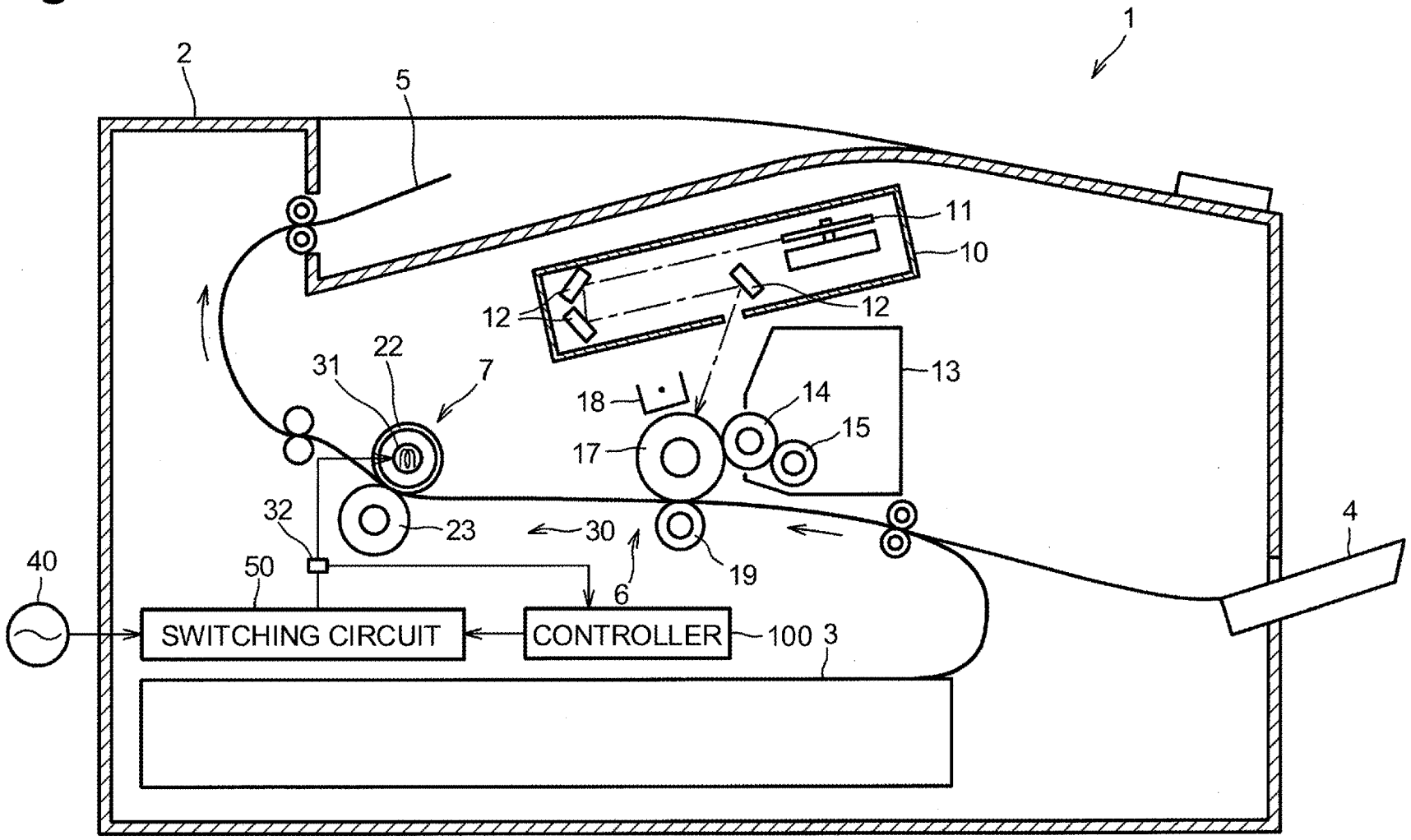
FIG. 1 is a cross-sectional view of a laser printer in an illustrative embodiment according to one or more aspects of the disclosure.

As depicted in FIG. 1, an image forming apparatus, e.g., a laser printer 1, is configured to form an image on a sheet 5. The laser printer 1 includes a casing 2, a sheet feeder 3, a manual tray 4, a process unit 6, a fuser 7, a switching circuit 50, a current sensor 32, and a controller 100. Each of one or more sheets 5 is conveyed from the sheet feeder 3 or the manual tray 4 to an exterior of the laser printer 1, through the process unit 6 and the fuser 7, in a conveying direction indicated by arrows.

The process unit 6 is configured to form a toner image in a sheet 5. The process unit 6 includes a scanner 10, a developing cartridge 13, a photosensitive drum 17, a charger 18, and a transfer roller 19.

The scanner 10 is located in the casing 2 at an upper portion thereof. The scanner 10 includes a laser beam emitter (not depicted), a polygon mirror 11, reflecting mirrors 12, and lenses (not depicted). The scanner 10 is configured to scan a surface of the photosensitive drum 17 by emitting laser beams from the laser beam emitter to the surface of the drum 17, via the polygon mirror 11, the reflecting mirrors 12, and the lenses (not depicted), as indicated by alternate long and short dash lines.

The developing cartridge 13 includes a developer roller 14 and a supply roller 15. The developing cartridge 13 holds toner therein. The developer roller 14 faces the photosensitive drum 17. The supply roller 15 is configured to supply the toner to the developer roller 14. The toner in the developing cartridge 13 is supplied to the developer roller 14 by the rotation of the supply roller 15 and is carried on the developer roller 14.

The charger 18 is disposed above the photosensitive drum 17 with a space therebetween. The transfer roller 19 is disposed below the photosensitive drum 17, facing the photosensitive drum 17.

The photosensitive drum 17 is charged by the charger 18 while rotating. The photosensitive drum 17 is exposed to the laser beams from the scanner 10, thereby forming an electrostatic latent image on the surface of the photosensitive drum 17. The electrostatic latent image on the photosensitive drum 17 is then developed into a toner image by the application of the toner with the developer roller 14. When the sheet 5 passes between the photosensitive drum 17 and the transfer roller 19, the toner image on the photosensitive drum 17 is transferred on the sheet 5 with transfer bias applied to the transfer roller 19.

The fuser 7 is disposed downstream of the process unit 6 in the conveying direction. The fuser 7 includes a heat member 22 that is a cylindrical fusing roller configured to apply heat to a sheet 5, and a pressure roller 23 pressed against the heat member 22. The heat member 22 includes a heater 31 disposed inside the heat member 22 and applies heat to the heat member 22. Examples of the heater 31 may include a halogen lamp having a filament that serves as a resistor. The halogen lamp is configured to heat the heat member 22 by radiant heat from the filament. The fuser 7 fuses the toner image using the heater 31 onto the sheet 5 that is held between the heat member 22 and the pressure roller 23.

The switching circuit 50 is connected to an external AC power supply 40, which is located outside the laser printer 1. The controller 100 controls the switching circuit 50 to be turned on (energized). The controller 100 outputs to the switching circuit 50, a turn-on signal for turning the switching circuit 50 on. The switching circuit 50 is turned off at the end of each half cycle. While the switching circuit 50 is turned on under the control of the controller 100, the heater 31 receives alternating current from the AC power supply 40.

The current sensor 32 is configured to output a signal corresponding to or representing a value of current flowing in the heater 31. When the value of current flowing in the heater 31 is greater than or equal to a current value I1, the current sensor 32 outputs a signal representing a maximum current value Imax, to the controller 100. In this illustrative embodiment, the maximum current value Imax corresponds to the current value I1 and their relationship is represented by the equation "Imax=I1".

The controller 100 includes a CPU, a RAM, a ROM, and an input/output circuit. The controller 100 is configured to execute various processing, by performing operations based on print instructions output from external computers, signals output from the current sensor 32, and programs and data stored in, for example, the ROM.

Figure 2A:
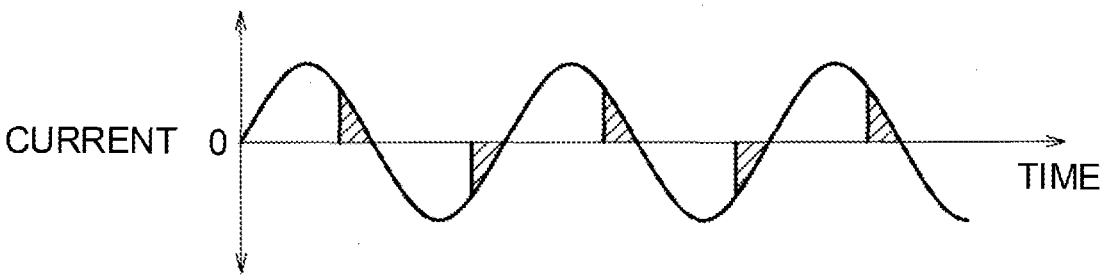
FIG. 2A is a waveform diagram illustrating phase control to be performed by a laser printer in an illustrative embodiment according to one or more aspects of the disclosure.
Figure 2B:
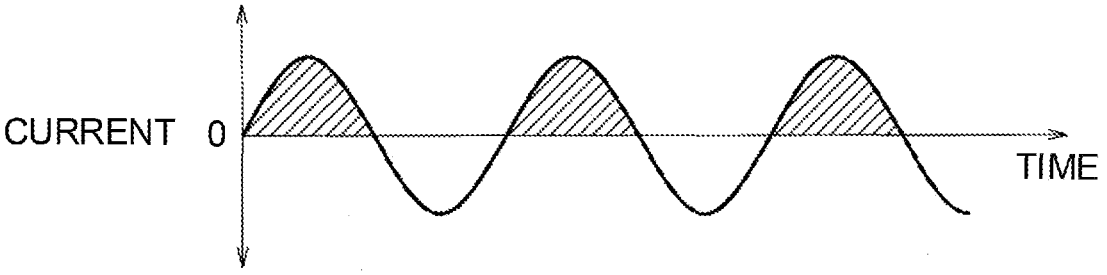
FIG. 2B is a waveform diagram illustrating wave-number control to be performed by a laser printer in an illustrative embodiment according to one or more aspects of the disclosure.

The controller 100 is configured to execute current supply control including phase control as depicted in FIG. 2A and wave-number control (which may also be called "zero-crossing control" or "burst firing") as depicted in FIG. 2B. After the printer 1 is powered on, the phase control may be executed first and then the wave-number control. The controller 100 has a function to change or switch the current supply control from the phase control to the wave-number control, which will be described in detail below.

The phase control is a method for controlling the switching circuit 50 to be turned on to supply current to the heater 31 at a particular time in each half cycle of a sine wave of alternating current. In the illustrative embodiment, as depicted in FIG. 2A, the phase control may be effected at a time later than a peak of each half cycle of the alternating current.

The wave-number control is a method for controlling the switching circuit 50 to be turned on completely through a half cycle. In the illustrative embodiment, as depicted in FIG. 2B, the wave-number control may be effected, for example, such that the switching circuit 50 is turned on and off alternatively for every half cycle.

Figure 3:
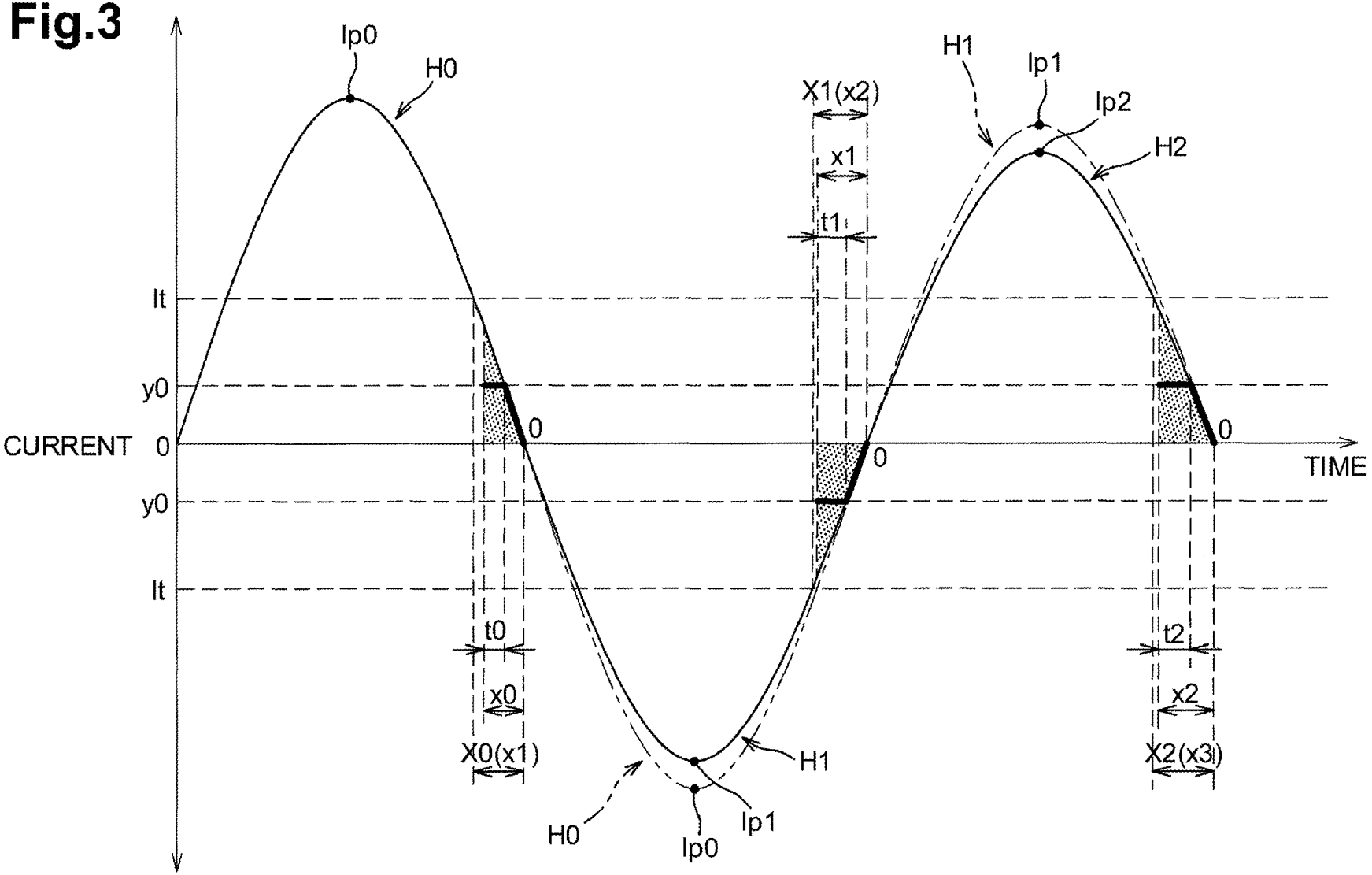
FIG. 3 is a waveform diagram showing how to calculate a phase angle in a laser printer in an illustrative embodiment according to one or more aspects of the disclosure.

The heater 31 may be supplied with alternating current, under the control of the controller 100 executing the phase control as depicted in FIG. 3, based on phase angles x corresponding to current values, each of which does not exceed a current value It. The current value It is greater than the current value I1, and is equal to or less than a maximum allowable current that is allowed to be supplied to the heater 31 in the phase control. The maximum allowable current in the phase control may be appropriately determined by experiments and simulations.

During the phase control, the controller 100 determines a saturation time t (e.g., t0), which is a period of time in which a value of current represented by a signal output from the current sensor 32 is greater than or equal to a threshold y0. The threshold y0 is less than or equal to the maximum current value Imax. Based on the saturation time t (e.g., t0), the controller 100 calculates a phase angle x (e.g., x1) for a particular half cycle. The controller 100 causes the switching circuit 50 to be turned on in a half cycle next (e.g., subsequent) to the particular half cycle at a time corresponding to the calculated phase angle x. For example, a dot-hatched portion in FIG. 3 represents an amount of current that flows in the heater 31. A bold line in FIG. 3 represents signals output from the current sensor 32.

In the illustrative embodiment, the threshold y0 is set to the same value as the maximum current value Imax. In short, in the illustrative embodiment, the relationship between the four values, that is the current value It; the current value I1; the maximum current value Imax; and the threshold y0, is represented by the following formula (1).

$$It > I1 = y0 = Imax \quad (1)$$

The controller 100 calculates the phase angle x(n+1) in the half cycle H(n+1) of the alternating current next to the particular half cycle Hn based on the following formula (2).

$$x(n+1)=\arcsin(It\cdot\sin(xn-tn)/y0) \quad (2)$$

where:

x(n+1): the phase angle to be used for the half cycle H(n+1) next to the particular half cycle Hn It: the current value greater than the maximum current value Imax xn: the phase angle used in the particular half cycle Hn of the alternating current tn: the saturation time in the particular half cycle Hn (or a phase angle corresponding to the saturation time tn)

y0: the threshold equal to the maximum current value Imax

In the illustrative embodiment, the phase angle xn is the phase angle used for the particular half cycle Hn. In the particular half cycle Hn, the controller 100 has output the turn-on signal to the switching circuit 50 at the time corresponding to the phase angle xn and current has been supplied to the heater 31. In other words, the current has been supplied to the heater 31 in the particular half cycle Hn before the phase angle x(n+1) for the next half cycle H(n+1) is calculated. In the illustrative embodiment, the phase angle xn to be used for the first time in the phase control is an initial phase angle x0, which is predetermined by experiments or simulations.

The initial phase angle x0 is determined such that a value of current that flows in the heater 31 at the start of the phase control is far less than the maximum allowable current that is allowed to be supplied to the heater 31 in the phase control. The initial phase angle x0 may be changed based on a phase angle x used at the end of the phase control, if necessary.

In the phase control, the controller 100 uses the phase angle xn (e.g., x0) in the particular half cycle Hn (e.g., H0), for calculation of the phase angle x(n+1) (e.g., x1) for the next half cycle H(n+1).

In this disclosure, phase angles in a horizontal axis in a waveform graph, for example, as depicted in FIG. 3, are described with the end of a half cycle (e.g., the right end of a half cycle) as a phase angle of zero degrees and increase from the right end of a half cycle toward the left end of the half cycle in a range from 0 to 90 degrees. This may be different from a normal angle scale of alternating current waveform graphs in which phase angles gradually increase from the left end of a half cycle toward its right end. For example, in FIG. 3, a point in a particular half cycle (e.g., H0) where an absolute value of the current decreases to zero is defined as a phase angle of zero degrees. From this point, phase angles gradually increase toward the peak value (e.g., Ip0) of the particular half cycle in a range from 0 to 90 degrees.

The current flowing into the heater 31 at the start of the phase control has the greatest amplitude. As the heater 31 is heated to higher temperatures, amplitudes of half cycles gradually decrease and then tend to remain constant. This can be seen in an example of FIG. 3, in which amplitude of a half cycle decreases in its next half cycle.

The following describes how formula (2) is obtained. The following formula (3) is satisfied, for example, in the half cycle H0.

$$Ip0\cdot\sin(x0-t0)=y0 \quad (3)$$

where:

Ip0: the peak value of the half cycle H0

In the formula (3), each of the values x0 and y0 is a known value, and the value t0 is a measured value. The peak value Ip0 of the half cycle H0 can be obtained by the following formula (4).

$$Ip0=y0/\sin(x0-t0) \quad (4)$$

An ideal phase angle X0 in the half cycle H0 for supplying current of the current value It to the heater 31 can be represented by the following formula (5).

$$Ip0\cdot\sin X0=It \quad (5)$$

The ideal phase angle X0 in the half cycle H0 is used as a phase angle x1 in the next half cycle H1. The relationship between the phase angle x0 in the half cycle H0 and the phase angle x1 in the next half cycle H1 can be expressed by the following formula (6). The formula (6) can be obtained by substituting the formula (4) for Ip0 in the formula (5).

$$X0=x1=\arcsin(It\cdot\sin(x0-t0)/y0) \quad (6)$$

The formula (6) can be expressed in the relationship between the phase angle xn in the particular half cycle Hn and the phase angle x(n+1) in the next half cycle H(n+1). This leads to the formula (2).

When the saturation time t is greater than or equal to a threshold T2, the controller 100 changes or switches the current supply control from the phase control to the wave-number control. The threshold T2 is used for determination as to whether the current supply control is switched from the phase control to the wave-number control.

The following describes the flow of operations of the controller 100. After the laser printer 1 is powered on and activated, the controller 100 repeatedly executes control processing as depicted in the flowchart of FIG. 4.

Figure 4:
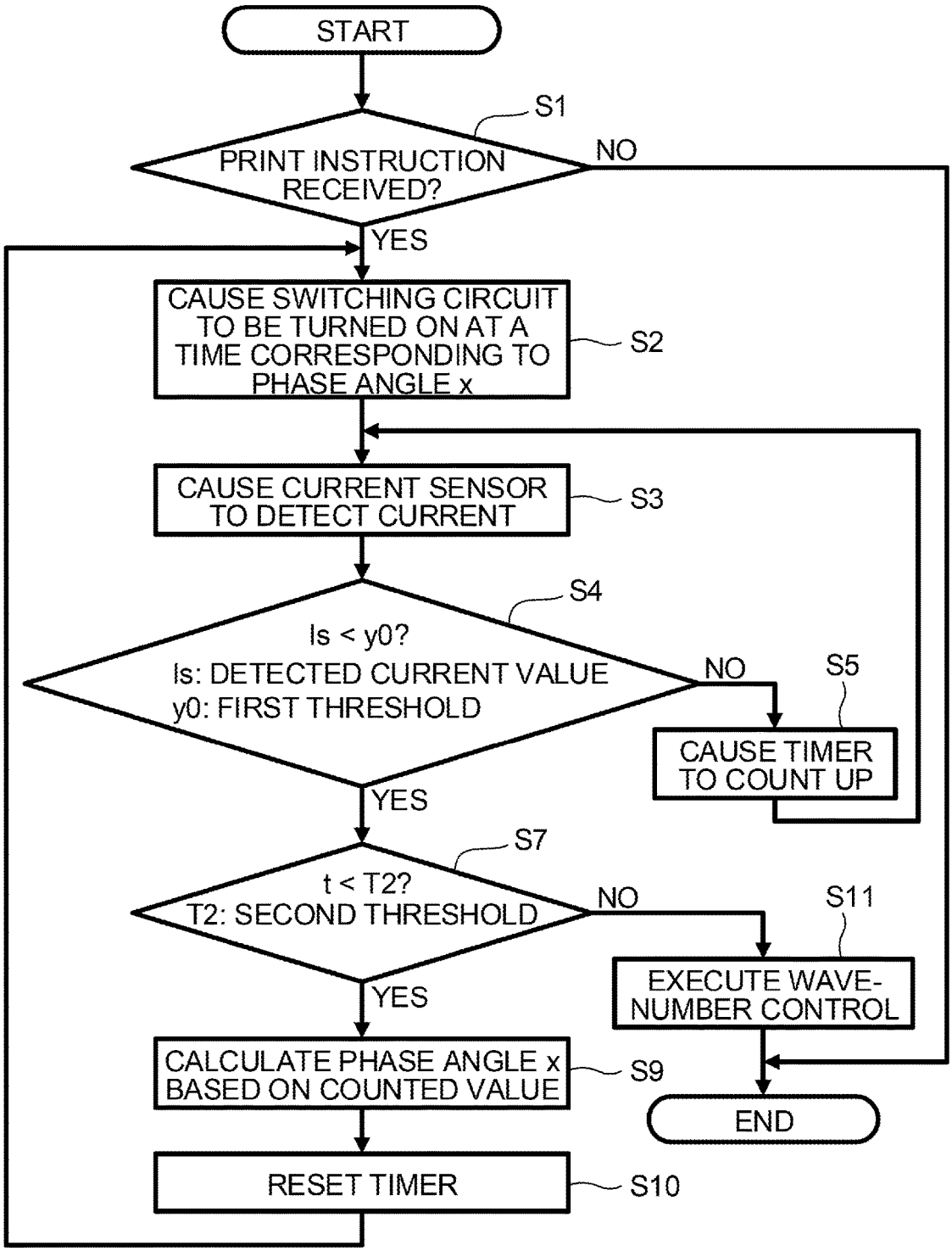
FIG. 4 is a flowchart illustrating operations of a controller of a laser printer in an illustrative embodiment according to one or more aspects of the disclosure.

As depicted in FIG. 4, the controller 100 determines whether the printer 1 has received a print instruction (S1). If the controller 100 determines in step Si that the printer 1 has not received a print instruction (No), the controller 100 ends this control processing.

If the controller 100 determines in step S1 that the printer 1 has received a print instruction (Yes), the controller 100 causes the switching circuit 50 to be turned on at a time corresponding to a phase angle x (S2). In one example, when executing step S2 for the first time subsequent to determining in step S1 that the printer 1 has received a print instruction (Yes), the controller 100 uses the initial phase angle x0 for the phase angle x.

Subsequent to step S2, the controller 100 causes the current sensor 32 to detect the current flowing in the heater 31 (S3). Subsequent to step S3, the controller 100 determines whether a current value Is detected by the current sensor 32 is greater than or equal to the threshold y0 (S4).

If the controller 100 determines in step S4 that the current value Is is not less than the threshold y0 (No), the controller 100 causes a timer (not depicted) to count up (S5). A value counted by the timer is used as a saturation time t for the calculation of a phase angle x for the next half cycle. Subsequent to step S5, the controller 100 returns to step S3. If the controller 100 determines in step S4 that the current value Is is less than the threshold y0 (Is<y0) (Yes), the controller 100 proceeds to step S7.

In step S7, the controller 100 determines whether the saturation time t is less than the threshold T2. If the controller 100 determines in step S7 that the saturation time t is less than the threshold T2 (t<T2) (Yes), the controller 100 calculates a phase angle x, based on the saturation time t counted up in step S5, the phase angle x corresponding to the time in which the switching circuit 50 is turned on in step S2, and the formula (2) (S9). Subsequent to step S9, the controller 100 resets the timer, so that the saturation time t measured by the timer is reset to zero (S10). Subsequently, the controller 100 returns to step S2, in which the controller 100 uses a value of the phase angle x calculated in step S9.

If the controller 100 determines in step S7 that the saturation time t is greater than or equal to the threshold T2 (No), the controller 100 executes the wave-number control until printing is finished (S11). Subsequent to step S11, the controller ends the control processing.

Figure 5:
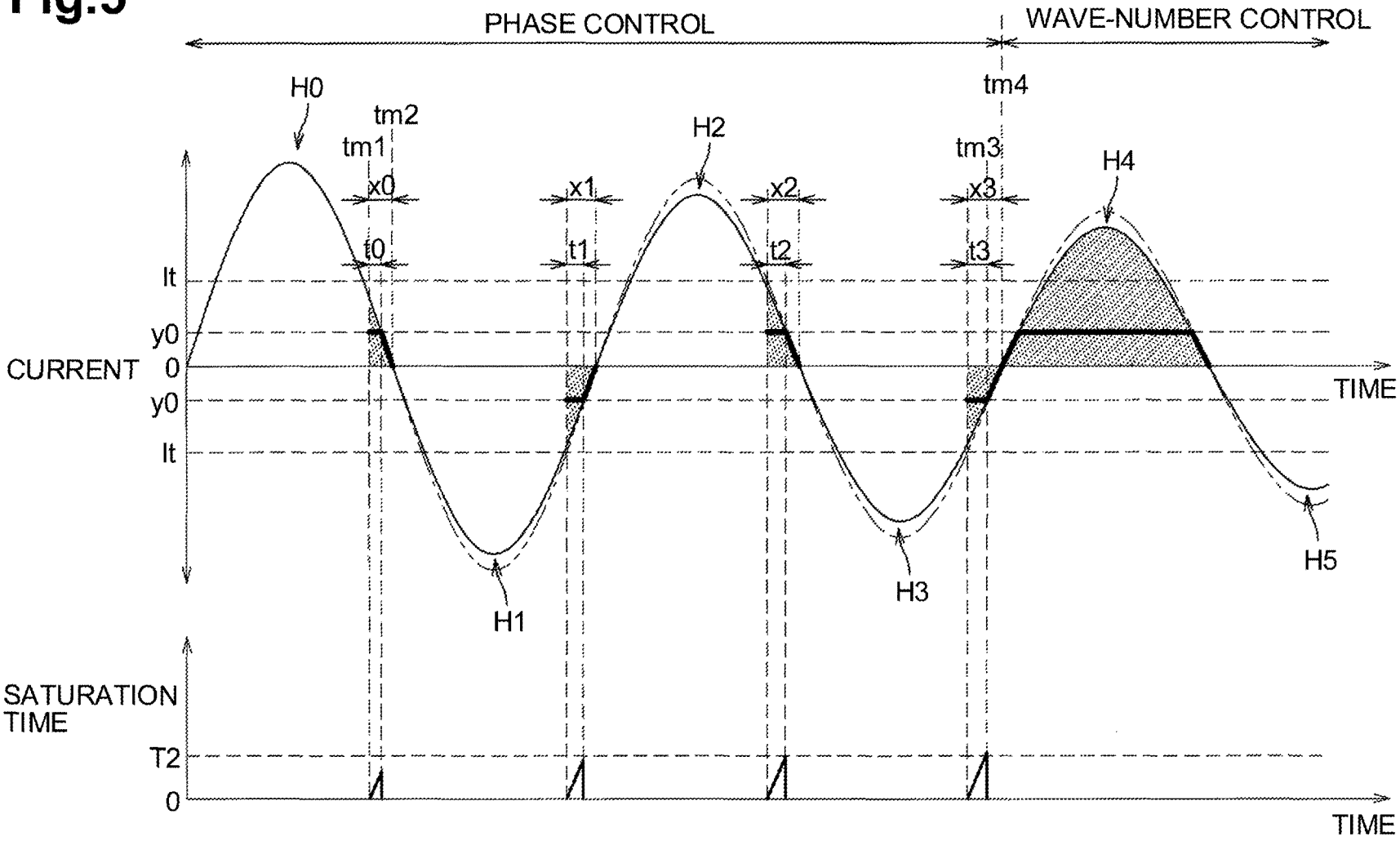
FIG. 5 is a time chart showing times associated with exemplary operations of a controller of a laser printer in an illustrative embodiment according to one or more aspects of the disclosure.

The following describes how the controller 100 operates in one example, in conjunction with FIG. 5.

As depicted in FIG. 5, based on the reception of a print instruction by the printer 1, the controller 100 causes the switching circuit 50 to be turned on at a time (time tm1) corresponding to the initial phase angle x0, thereby causing the current to start flowing into the heater 31 at a time later in the half cycle H0 than its peak. Subsequently, the switching circuit 50 is turned off at a time (time tm2) when a value of the alternating current from the AC power supply 40 reaches zero.

In the half cycle H0, the controller 100 causes the timer to count up, thereby measuring the saturation time t0. The controller 100 performs calculations using the saturation time t0 to obtain the phase angle x1 for the next half cycle H1. In each of the half cycles H1, H2, and H3, the controller 100 similarly performs calculations to obtain phase angles. Amplitudes of the half cycles H0-H3 gradually decrease. In the respective half cycles H0-H3, rates of change in current with respect to time gradually decrease. The saturation times t1-t3 in the respective half cycles H0-H3 gradually increase.

If the controller 100 determines, at the time tm3, that the saturation time t3 is greater than or equal to the threshold T2, e.g., the amplitude of the current is sufficiently decreased, the controller 100 changes the control of current supply to the heater 31, from the phase control to the wave-number control (e.g., at the time tm4). It should be noted that the controller 100 in the illustrative embodiment, has processing capacity high enough to determine whether the saturation time t3 is greater than or equal to the threshold T2 in a short period of time from the end of the measurement of the saturation time t3 in the half cycle H3 to a time when the alternating current value reaches zero.

If the controller 100 fails to determine whether the saturation time t3 is greater than or equal to the threshold T2 in such short period of time, the controller 100 may continue the phase control in the next half cycle H4 and execute the wave-number control in the half cycle H5 and subsequent half cycles.

The illustrative embodiment may have such effects as described below.

The current sensor 32 is configured to output a signal representing the maximum current value Imax when the current flowing in the heater 31 is greater than or equal to the current value I1, which is less than the current value It. The current sensor 32 may detect a relatively small current with precision. The phase angle x is calculated based on the saturation time t. This configuration may allow a relatively great amount of current to be supplied to the heater 31 and may effectively increase temperatures of the heater 31, for example, as compared with a configuration in which a fixed phase angle is used to supply current to the heater 31. The current sensor 32 configured to output a signal representing the maximum current value Imax may have a lower cost than a current sensor configured to output a signal representing a maximum current value that is greater than the maximum current value Imax.

If the saturation time t3 is greater than or equal to the threshold T2 (e.g., the amplitude of the current is sufficiently decreased), the control of current supply to the heater 31 is changed from the phase control to the wave-number control. This configuration may reduce excessive current flow to the heater 31 in the wave-number control.

The ideal phase angle Xn in the particular half cycle Hn (e.g., H0) may be used as the phase angle x(n+1) in the next half cycle H(n+1) (e.g., H1), to supply the alternating current to the heater 31. This configuration may reduce a difference between the current flowing to the heater 31 and the current value It, for example, as compared with a configuration in which the ideal phase angle Xn in the half cycle Hn is used for, for example, a half cycle H(n+2).

While the disclosure has been described in detail with reference to the specific embodiment thereof, various changes, arrangements and modifications may be applied therein without departing from the spirit and scope of the disclosure. In the following description of modifications, like numerals denote like elements and the detailed description of those elements described above is omitted.

The following formula (7) may be used, instead of the formula (2) used in the illustrative embodiment, for the calculation of the phase angle x(n+1).

$$x(n+1)=It\cdot(xn-tn)/y0 \tag{7}$$

where:

x(n+1): the phase angle to be used for the half cycle H(n+1) next to the particular half cycle Hn It: the current value greater than the maximum current value Imax xn: the phase angle used in the particular half cycle Hn of the alternating current tn: the saturation time in the particular half cycle Hn (or a phase angle corresponding to the saturation time tn)

y0: the threshold equal to the maximum current value Imax

This configuration may reduce processing burden on the controller 100, as compared with the configuration of the illustrative embodiment, because the phase angle x is calculated without using inverse trigonometric function.

The formula (7) is an approximation formula in which sin θ in the formula (2) is regarded as θ. The phase angle x obtained using the formula (7) may be multiplied by a correction factor α, to correct the obtained phase angle x or to bring a calculation result obtained by the formula (7) closer to a calculation result obtained by the formula (2).

In the illustrative embodiment, the threshold y0 is set to the same value as the maximum current value Imax, which corresponds to a maximum value of a signal that the current sensor 32 outputs. In another embodiment, the threshold y0 may be set to a value smaller than the maximum current value Imax. This configuration may accurately measure the saturation time t, as compared with a configuration in which the threshold y0 is set to the same value as the maximum current value Imax, for example, in such a case where the current sensor 32 may not detect the current flowing in the heater 31 correctly and output a signal representing a current value lower than the maximum current value Imax when the current flowing in the heater 31 is greater than or equal to the current value I1.

In the illustrative embodiment, the phase angle x in the particular half cycle is used for the calculation of a phase angle x for the next half cycle. Alternatively, the phase angle x in the particular half cycle H may be used for the calculation of a phase angle x for a half cycle subsequent to the next half cycle.

In the illustrative embodiment, aspects of the disclosure are applied to the laser printer 1. In another embodiment, aspects of the disclosure may be applied to other types of image forming apparatuses, such as copiers and multi-functional devices.

In the illustrative embodiment, the halogen lamp serves as the heater 31. In another embodiment, a carbon heater may serve as the heater 31.

Each of the elements or parts which have been described in the illustrative embodiment and modifications may be used in any combination.

What is claimed is:

1. A heating system comprising:

a heater;

a switching circuit connected to the heater and configured to be turned on by a turn-on signal, the switching circuit (50) being turned on when alternating current is supplied to the heater;

a current sensor connected between the heater and the switching circuit, the current sensor being configured to output a signal corresponding to a value of current flowing in the current sensor; and a controller configured to:

output to the switching circuit, the turn-on signal at a time corresponding to a first phase angle (xn) in a particular half cycle (Hn) of the alternating current;

determine a period of time (tn) from the time of the turn-on signal in which a value of current represented by a signal output by the current sensor continues to be greater than or equal to a first threshold (y0) during the particular half cycle;

calculate a second phase angle (x(n+1)) based on the determined period of time (tn); and output to the switching circuit, the turn-on signal at a time corresponding to the calculated second phase angle (x(n+1)) in a half cycle (H(n+1)) following the particular half cycle (Hn).

2. The heating system according to claim 1, wherein the current sensor is configured to output a signal representing a maximum current value (Imax) of the current sensor when the value of current flowing in the current sensor is greater than or equal to the first threshold (y0), and wherein the controller is configured to output to the switching circuit, the turn-on signal at the time corresponding to the first phase angle (xn) corresponding to a current value (It) greater than the maximum current value (Imax).

3. The heating system according to claim 1, wherein the controller is configured to calculate the second phase angle (x(n+1)) based on the determined period of time (tn) and the first phase angle (xn).

4. The heating system according to claim 3, wherein the controller is configured to calculate the second phase angle (x(n+1)) based on a following formula:

$$x(n+1)=\arcsin(It\cdot\sin(xn-tn)/y0)$$

where:

x(n+1): the second phase angle;

It: the current value greater than the maximum current value (Imax);

xn: the first phase angle;

tn: the period of time; and y0: the first threshold.

5. The heating system according to claim 3, wherein the controller is configured to calculate the second phase angle (x(n+1)) based on a following formula:

$$x(n+1)=It\cdot(xn-tn)/y0;$$

where:

x(n+1): the second phase angle;

It: the current value greater than the maximum current value (Imax);

xn: the first phase angle;

tn: the period of time; and y0: the first threshold.

6. The heating system according to claim 5, wherein the controller is configured to multiply the calculated second phase angle (x(n+1)) by a correction factor α.

7. The heating system according to claim 2, wherein the first threshold (y0) is set to a value smaller than the maximum current value (Imax).

8. The heating system according to claim 1, wherein, when the period of time (tn) is less than a second threshold (T2), the controller is configured to output to the switching circuit, the turn-on signal at the time corresponding to the calculated second phase angle (x(n+1)), and wherein, when the period of time (tn) is greater than or equal to the second threshold (T2), the controller is configured to execute a wave-number control.

9. The heating system according to claim 1, wherein the half cycle following the particular half cycle comprises a next half cycle following the particular half cycle.

10. The heating system according to claim 1, wherein the alternating current comprises a sine wave.

11. The heating system according to claim 1, wherein the heater is installed within an image forming apparatus.

12. An image forming apparatus comprising:

a heater;

a switching circuit electrically connected between an alternating current power supply and the heater;

a current sensor electrically connected between the switching circuit and the heater, the current sensor configured to output a current signal representing a sensed current; and a controller communicatively connected to the switching circuit and the current sensor, the controller being configured to:

at a predetermined time during a half cycle of an alternating current signal provided by the alternating current power supply, output an activation signal to the switching circuit to provide alternating current to the heater;

receive the current signal from the current sensor indicative of the alternating current supplied to the heater;

based on an elapsed time from the outputting of the activation signal that the current signal is at least at a predetermined signal level during the half cycle, calculate a second time from which the alternating current signal does not exceed a current threshold for a remainder of the half cycle; and during a second half cycle of the alternating current signal following the half cycle, output a second activation signal to the switching circuit at the calculated second time.

13. The image forming apparatus of claim 12, wherein the current threshold is greater than a current indicated by the current signal at the predetermined signal level.

14. The image forming apparatus of claim 12, wherein the current signal has a value that is output in response to the sensed current being at or above a threshold current.

15. The image forming apparatus of claim 14, wherein the value comprises a constant value.

16. The image forming apparatus of claim 14, wherein the value comprises a maximum value output from the current sensor.

17. The image forming apparatus of claim 12, wherein the alternating current signal comprises a sine wave.

18. The image forming apparatus of claim 12, wherein the second half cycle comprises a half cycle immediately following the half cycle.

19. The image forming apparatus of claim 12, wherein the second half cycle comprises an opposite phase half cycle immediately following the half cycle.

20. The image forming apparatus of claim 12, wherein the half cycle and the second half cycle cooperatively form a full cycle of the alternating current signal.

21. An image forming apparatus comprising:

a heater;

a switching circuit electrically connected between an alternating current power supply and the heater;

a current sensor electrically connected between the switching circuit and the heater, the current sensor configured to output a current signal corresponding to a sensed current and having a maximum current value output when the sensed current is greater than or equal to a first current value; and a controller communicatively connected to the switching circuit and the current sensor, the controller being configured to:

at a predetermined time during a half cycle of an alternating current signal provided by the alternating current power supply, output an activation signal to the switching circuit to provide alternating current to the heater;

receive the current signal from the current sensor indicative of the alternating current supplied to the heater; and based on a determination that the current signal is at the maximum current value during the half cycle for at least some time period, in a second half of a subsequent half cycle, output a second activation signal to the switching circuit at a second time offset from completion of the subsequent half cycle a greater amount than the predetermined time is offset from completion of the half cycle.

* * * * *